United States Patent [19]

Nackenson

[11] 4,114,240

[45] Sep. 19, 1978

[54] ROUND BACK SPRING BINDER

[75] Inventor: Joel J. Nackenson, Valley Stream, N.Y.

[73] Assignee: J.J. Lester & Co., Inc., Valley Stream, N.Y.

[21] Appl. No.: 826,925

[22] Filed: Aug. 22, 1977

[51] Int. Cl.[2] ..... B42F 1/00

[52] U.S. Cl. ..... 24/67.11

[58] Field of Search ..... 24/67.3, 67.5, 67.7, 24/67.9, 67.11; 402/12, 13, 68; 281/25 R, 25 A

[56] References Cited

U.S. PATENT DOCUMENTS

| | | | |
|---|---|---|---|
| 307,817 | 11/1884 | Tapley | 281/25 R |
| 475,425 | 5/1892 | Vawter et al. | 24/67.5 |
| 841,823 | 1/1907 | Storrs | 24/67.3 |
| 1,741,909 | 12/1929 | Belohlavek | 24/67.11 |

FOREIGN PATENT DOCUMENTS

| | | | |
|---|---|---|---|
| 1,058,094 | 2/1967 | United Kingdom | 24/67.5 |

*Primary Examiner*—Henry S. Jaudon
*Attorney, Agent, or Firm*—Stoll and Stoll

[57] ABSTRACT

A round back spring binder having spring clamp elements formed with intersecting end portions which have to be spread apart in order to assemble the spring clamp elements into the binder, thereby pre-loading the back of the binder with an initial spring bias. When spread apart, the end portions of the spring clamp elements are angled toward a common line which is centered with respect to the back of the binder.

7 Claims, 19 Drawing Figures

ROUND BACK SPRING BINDER

BACKGROUND OF THE INVENTION

1. Field of the Invention

This invention relates to spring back loose leaf binders.

2. Description of the Prior Art

The closest prior patent art known to applicant consists of the following U.S. Pat. Nos.:

210,193
664,544
755,380
1,347,342
2,229,936
2,607,351
2,729,835
2,731,967
2,906,268

In addition to the above-cited prior art, is a practice in the industry (e.g., by applicant) of constructing spring back binders with asymmetrical springs in order to attain a preload condition. This prior art practice is illustrated in FIGS. 1, 2 and 2A of the drawing. Aside from the fact that the resultant pre-load is minimal — sometimes entirely lacking — this practice produces a disaligned binder which has the appearance of being defective.

Another practice in the industry is to construct spring back binders with symmetrical springs and to provide an inner folder for the binder which fills the gap between the opposing ends of the springs. FIG. 2B of the drawing shows a typical symmetrical spring wherein the spring arms focus upon a common line. However, it has not been found feasible to maintain the ends of the arms in contact with each other. The result is a balanced spring but with a gap between the ends of the arms. By definition, this precludes an initial or pre-load condition and, as has above been stated, this gap is sometimes filled by means of a folder which is placed within the binder.

SUMMARY OF THE INVENTION

This invention provides a spring back binder having symmetrical spring elements with a positive preload which enables it to grip minimal leaf thicknesses securely. The principle of the invention resides in the use of spring elements having intersecting and bypassing arms which must be spread apart when assembled into the binder. Spreading the spring arms apart impresses a spring bias upon the back of the binder and provides a functionally adequate preload condition.

As is shown in the drawing, there are different ways of providing intersecting and bypassing spring arms. One way is to form interdigitated fingers on the spring arms; another way is to notch the arms at alternate locations; and a third way is to form the arms along parallel, diagonal lines. In each case, the spring arms symmetrically bypass each other. In order to assemble these springs into the binder it is necessary to spread their arms apart to the point where they are no longer intersecting. This impresses a preload on the springs which enables the binder to grip small numbers of relatively thin loose leaf sheets, even a single such sheet. Moreover, the springs remain at all times symmetrical and this gives the binder a symmetrical appearance.

DESCRIPTION OF PREFERRED EMBODIMENTS OF INVENTION

Figure 1:
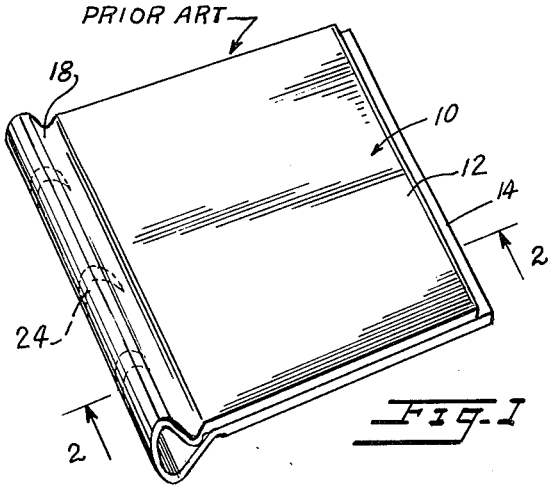
FIG. 1 is a perspective view of a round back spring binder made in accordance with the prior art.
Figure 2A:
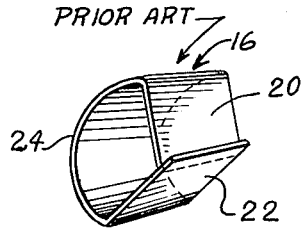
FIG. 2A is a perspective view of a typical asymmetrical clamp spring element used in said prior art binder.
Figure 2B:
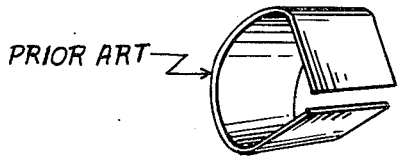
FIG. 2B is a perspective view of a typical symmetrical clamp spring element which is used in some prior art binders.
Figure 2:
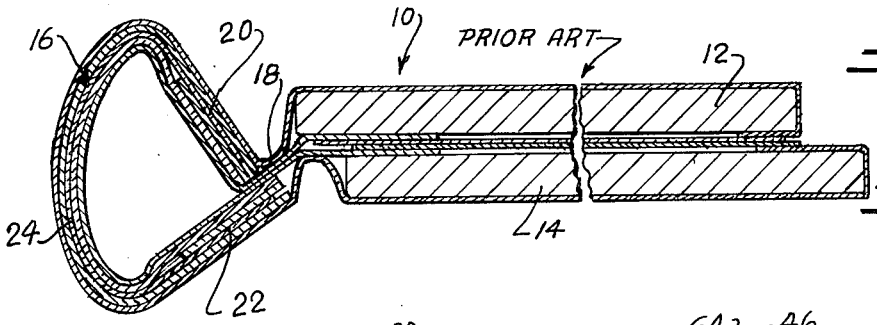
FIG. 2 is a section on the line 2—2 of FIG. 1.
Figure 3:
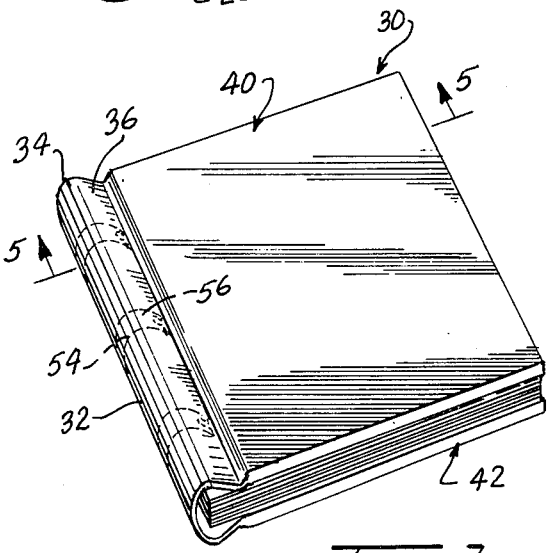
FIG. 3 is a perspective view of a round back spring binder made in accordance with one form of this invention.
Figure 4:
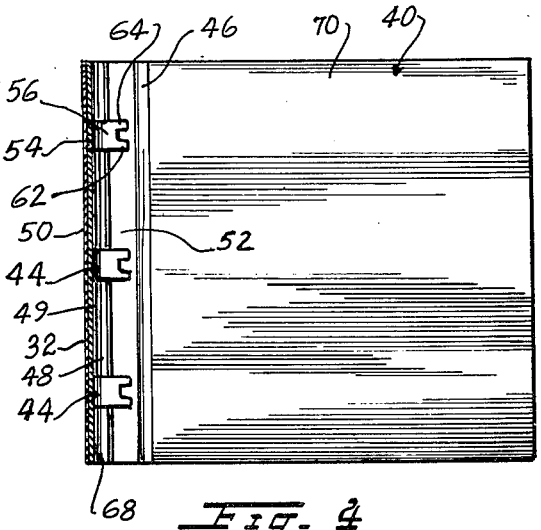
FIG. 4 is a top view of said binder with its outer covering removed to show the construction thereof, partially in cross-section.
Figure 5:
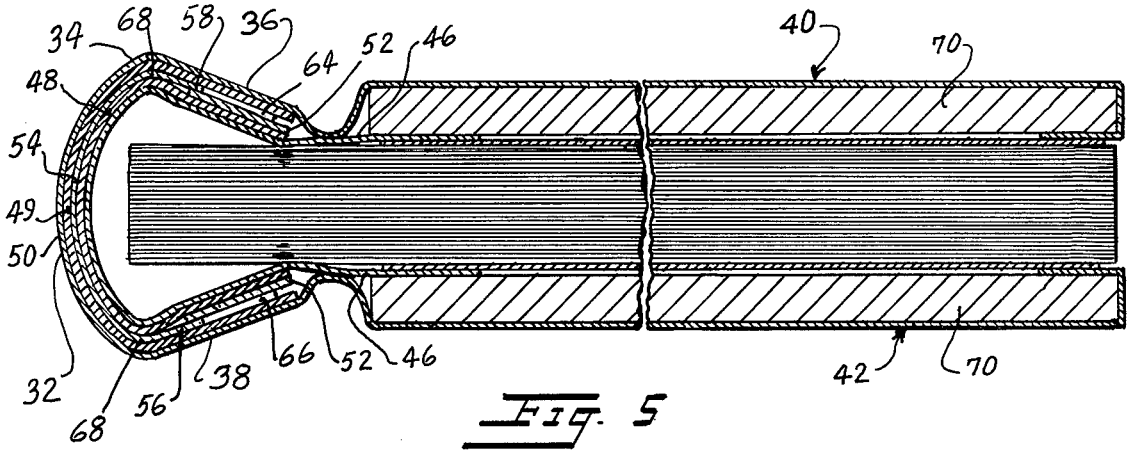
FIG. 5 is a section on the line 5—5 of FIG. 3.
Figure 6:
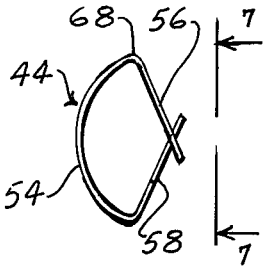
FIG. 6 is an end view of the clamp spring element which is used in the construction of the binder which is illustrated in FIGS. 3, 4 and 5.
Figure 7:
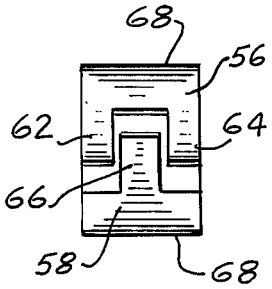
FIG. 7 is a front view of said clamp spring element looking in the direction of arrows 7,7 of FIG. 6.
Figure 8:
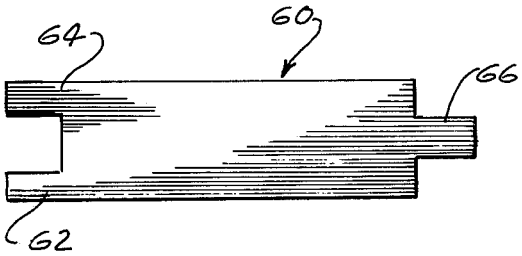
FIG. 8 is a plan view of the blank from which the said spring clamp element is made.
Figure 9:
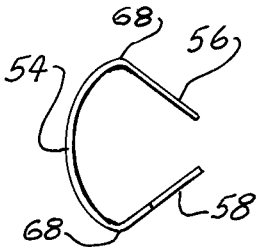
FIG. 9 is an end view of said spring clamp element, similar to that of FIG. 6, except that it is spread apart preparatory to being assembled into the binder.
Figure 10:
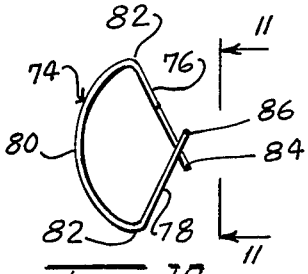
FIG. 10 is an end view of a spring clamp element made in accordance with a second form of this invention.
Figure 11:
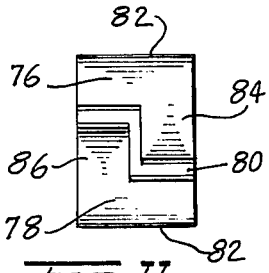
FIG. 11 is a front view thereof looking in the direction of arrows 11,11 of FIG. 10.
Figure 13:
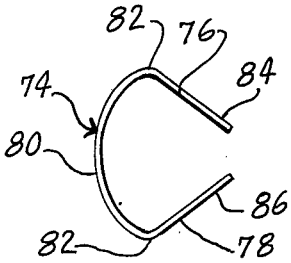
FIG. 13 is an end view of said spring clamp element, similar to that of FIG. 10, but showing it spread apart preparatory to being assembled into the binder.
Figure 12:
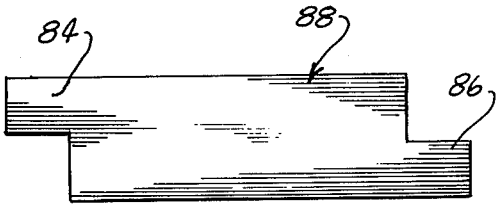
FIG. 12 is a plan view of a blank from which the spring clamp element of FIGS. 10 & 11 is made.

Referring to the first instance to one form of prior art as presently practiced in the industry, and to FIGS. 1, 2 and 2A of the drawing, it will be observed that conventional round back spring binder 10 comprises a pair cover panels 12 and 14, a spring back 16, and hinge means 18 is hingedly attaching the cover panels to the spring back. What is significant in this conventional construction is that arms 20 and 22 of the spring clamp elements are asymmetrically disposed relative to each other in that their respective ends fail to meet along the clamping line of the binder. Instead, arm 20 is bent at a tighter angle relative to the yoke of the spring than is arm 22. Consequently, arm 22 tends to overlap arm 20, causing a misalignment in the cover panels of the binder.

The reason for this asymmetrical construction is that it impresses a preload on the spring element for the intended purpose of enabling the binder to grip relatively few sheets of loose leaf material. However, this purpose is not always attained and there is an inherent visible disadvantage in the construction, namely, the misalignment of the cover panels. This is evident from FIG. 2 of the drawing in which it is shown that one cover panel 14 extends beyond the other cover panel 12. Although this construction is highly undesirable it is nevertheless customarily used in the industry for want of a better, commercially feasible construction wherein a preload condition is attained. As has been stated, the use of symmetrical or balanced springs (see FIG. 2B) does not produce the desired pre-load condition.

Referring now to the first embodiment of the present invention as illustrated in FIGS. 3–9 of the drawing, it will be observed that round back spring binder 30 consists of the following component parts: a back member 32 having a curved back section 34 and a pair of side sections 36 and 38 extending from said curved back section, a pair of cover panels 40 and 42, and a plurality of spring clamp elements 44 which are assembled with said back member 32 and provide the spring clamping action of the binder. Back member 32 may be made in various ways but, in the conventional practice, it comprises the following elements: an inner layer 46 of fabric or other suitable sheet material, a pair of intermediate layers 48 and 49 made of fiber sheets or heavy paperboards or the like and an outer layer 50 of sheet material suited for the covering of binders, albums and the like. The inner fabric layer 46 is also attached to the cover panels and it functions as a hinge between the back 32 and the two cover panels 40 and 42. Outer layer 50 also covers the cover panels and, like the inner fabric layer 46, it functions as a hinging element between the back and the covers of the binder.

Another pair of elements in the assembly is a pair of metal stiffener strips 52 which are secured to and between the two intermediate layers 48 and 49. Stiffener strips 52 perform two important functions, namely, they provide the back of the binder with adequate rigidity and they function as anchorages for the spring clamp elements 44. As FIG. 4 clearly shows, there are three such spring clamp elements in the illustrated binder and it will be understood that these spring clamp elements are attached to the metal stiffener strips by spring pressure and to the intermediate fiber layer 49 by adhesive.

Turning now to the details of spring clamp element 44 as illustrated in FIGS. 6–9, it will be noted that it comprises a curved yoke 54 and a pair of arms 56 and 58 extending from said yoke. Yoke 54 of each of the three spring clamp elements 44 corresponds to curved back section 34 and arms 56, 58 correspond to side sections 36, 38. Spring clamp element 44 is made from a blank 60 which has a generally rectangular shape formed with a pair of laterally spaced fingers 62, 64 at one end thereof and a centrally disposed finger 66 formed at the opposite end thereof. When blank 60 is bent and formed to the shape of spring clamp element 44, arms 56 and 58 intersect, their respective fingers 62, 64 and 66 assuming an interdigitated relationship. Spring clamp element 44 is made of spring steel and it is this intersecting formation that impresses a preload upon the spring clamp element when its arms 56, 58 are spread apart for installation into the binder. See FIG. 9. The principle of this invention resides in the fact that the bend 68 between yoke 54 and arms 56, 58 may be tightened (radius reduced) in excess of the corresponding bend of the prior art as illustrated in FIGS. 1 and 2. This results from the intersecting and bypassing relationship between the arms in their relaxed or untensioned state. Since it is necessary to flex the structure (mainly yoke 54) in order to attain the installation configuration shown in FIG. 9, the structure is placed under tension sufficient to enable the binder to grip relatively few sheets of looseleaf material.

The binder construction is in other respects conventional. Thus, the cover panels 40 and 42 include relatively stiff paperboard or cardboard cores 70 and it will be observed that covering material 50 covers not only the back portion 32 but also the cover panels, forming a continuous covering extending over the entire binder.

Reference to the second form of this invention as illustrated in FIGS. 10–15, it will be understood that spring element 74 performs the same function in the binder as spring element 44 above described. The binder construction is in all respects similar to the construction above described; only the spring element is different. The principle also remains the same in that spring element 74 has a pair of intersecting arms 76, 78 extending from a bowed yoke 80. Arms 76 and 78 are intersecting because of the tight bend along bend lines 82. Arms 76 and 78 are capable of intersecting because they are provided with laterally offset end portions 84 and 86. These laterally offset end portions are clearly shown in FIGS. 10 and 11 and in the plan view of blank 88 (FIG. 12) from which the spring element 74 is made. In this form of the invention, as in the first form, the intersecting arms must be spread apart for assembly of the spring element into the binder. Spreading them apart produces the preload condition necessary to enable the binder to grip relatively few sheets of looseleaf material. The installation of spring element 74 into the binder is the same as previously described with respect to spring element 44. The arms of spring element 74 are secured to the stiffener strips of the binder and it is through these stiffener strips that the three spring elements in the binder are enabled to cooperate in biasing the binder.

Figure 14:
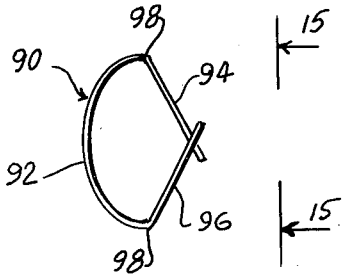
FIG. 14 is an end view of a spring clamp element made in accordance with a third form of this invention.
Figure 15:
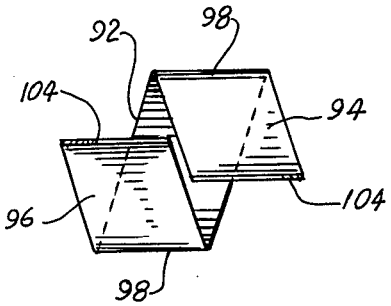
FIG. 15 is a front view of said spring clamp element, looking in the direction of arrows 15,15 of FIG. 14.

The third form of the invention is illustrated in FIGS. 14–17 of the drawing. There, spring element 90 comprises a bowed yoke 92 and a pair of arms 94 and 96 extending from said bowed yoke along bend lines 98. The angles defined by bends 98 are relatively small in relation to the corresponding angles of the prior art as shown in FIGS. 1 and 2. Arms 94 and 96 extend angularly from bend lines 98 and thereby assume diagonal positions in side by side relationship, one arm pointing in one direction, the other arm pointing in the opposite direction, and the two arms being thereby enabled to intersect as shown in FIG. 14 of the drawing.

Figure 16:
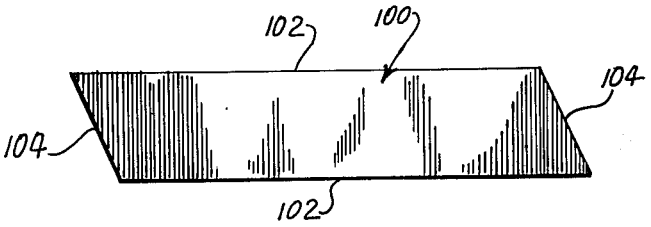
FIG. 16 is a plan view of a blank from which the spring clamp element of FIGS. 14 and 15.
Figure 17:
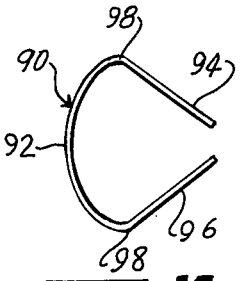
FIG. 17 is an end view of said spring clamp element, similar to that of FIG. 14, but showing it spread apart preparatory to it being assembled into the binder.

As FIG. 16 clearly shows blank 100 from which spring element 90 is made is a four sided figure having parallel sides 102 and parallel ends 104. There are no notches or fingers at the ends of this blank. Instead of interdigitating its ends (as is the case with spring elements 44 and 74) spring element 90 is formed in substantially helical configuration, the arms disposed in parallel bypassing relation to each other. It is this bypassing relationship which corresponds to the intersecting relationship of the arms of spring elements 44 and 74, and which makes it possible to preload said spring element 90 when its arms are spread apart for assembly into the binder. See FIG. 17.

The foregoing is a description of preferred embodiments of the invention and it will be understood that they are intended to illustrate, not limit, the invention. The scope of the invention is limited only by the limitation of the appended claims. For example, the stiffener strips may be made of suitable strip material other than the above-mentioned metal, and they may be attached by any conventional means other than the above-mentioned adhesive means.

I claim:

1. A round back spring binder comprising:

(a) a back member having a curved back section, a pair of side sections extending therefrom, and a pair of stiffener strips on said side sections, (b) a pair of cover panels hingedly connected to said side sections, and (c) spring clamp elements mounted on said back member and operating between its back and side sections, (d) said spring clamp elements comprising a curved spring yoke and a pair of arms extending integrally therefrom, said arms being secured to said stiffener strips, (e) said integral arms of the spring clamp elements having laterally offset end portions and said spring yoke of the spring clamp elements being bowed to bias said integral arms toward each other such that their offset end portions are normally held in intersecting relationship, (f) said integral arms of the spring clamp elements, when secured to the stiffener strips, being spread apart against the tension in the bowed spring yoke, (g) thereby imparting a spring bias in the back member of the binder sufficient to hold its side sections in tensioned engagement with each other prior to placement of insert material between them, and sufficient to enable said side sections to tensionally engage and hold insert material placed between them.

2. A round back spring binder in accordance with claim 1, wherein:

(a) the intersecting offset end portions of the arms of the spring clamp elements comprise interdigitated fingers, (b) at least one such finger centered on one such arm, (c) at least two such fingers spaced on the other arm to accommodate the first mentioned finger between them.

3. A round back spring binder in accordance with claim 1, wherein:

(a) the intersecting offset end portions of the arms of the spring clamp elements comprise a pair of offset fingers, (b) one such finger on one side of one of said arms, the other finger on the opposite side of the other of said arms, (c) whereby said fingers are positioned to bypass each other in intersecting relationship.

4. A round back spring binder in accordance with claim 1, wherein:

(a) the arms of the spring clamp elements extend diagonally in opposite directions from the curved yoke, (b) whereby the end portions of said arms are positioned to bypass each other in intersecting relationship.

5. A round back spring binder in accordance with claim 1, wherein:

(a) the cover panels are hingedly connected to the side sections of the back member by means of a continuous flexible sheet, (b) said flexible sheet being secured to the curved back and side sections of the back member, and being also secured to the two cover panels.

6. A round back spring binder in accordance with claim 5, wherein:

(a) the flexible sheet comprises a sheet of fabric, and (b) said sheet of fabric is adhesively secured to the inner surfaces of the curved back and side sections of the back member and the inner surfaces of the cover panels.

7. A round back spring binder in accordance with claim 6, wherein:

(a) additional hinging means is provided between the side sections of the back member and the cover panels, (b) said additional hinging means comprising sheet material which is adhesively secured to the outer surfaces of the curved back and side sections of the back member and the outer surfaces of the cover panels, (c) said sheet material constituting the outer covering of said back member and said cover panels.

* * * * *